United States Patent [19]

Story et al.

[11] Patent Number: 4,745,792

[45] Date of Patent: May 24, 1988

[54] BLANKHOLDER FOR A DRAW PRESS

[75] Inventors: James M. Story; Andrew B. Trageser, both of Plum Boro; George L. Smith, Jr., New Kensington, all of Pa.

[73] Assignee: Aluminum Company of America, Pittsburgh, Pa.

[21] Appl. No.: 918,112

[22] Filed: Oct. 14, 1986

[51] Int. Cl.[4] ..... B21D 22/21

[52] U.S. Cl. ..... 72/351

[58] Field of Search ..... 72/350, 351

[56] References Cited

U.S. PATENT DOCUMENTS

| | | | |
|---|---|---|---|
| 682,866 | 9/1901 | Asche | 72/351 |
| 3,349,153 | 10/1967 | Beck | 264/89 |
| 3,420,089 | 1/1969 | Myers | 72/351 |
| 3,494,169 | 2/1970 | Saunders | 72/350 |
| 4,090,389 | 5/1978 | van Denderen et al. | 72/350 |

FOREIGN PATENT DOCUMENTS

| | | | |
|---|---|---|---|
| 696625 | 9/1940 | Fed. Rep. of Germany | 72/351 |
| 38617 | 3/1983 | Japan | 72/351 |
| 280900 | 5/1952 | Switzerland | 72/351 |
| 1098616 | 6/1984 | U.S.S.R. | 72/351 |

*Primary Examiner*—Lowell A. Larson

*Attorney, Agent, or Firm*—Max L. Williamson

[57] ABSTRACT

A blankholder having a central opening for applying pressure against the flange of a blank being drawn through a die in a draw press. The blankholder is divided into individual segments defined by its inner and outer peripheries, at least one continuous divisional line intermediate the inner and outer peripheries, and radii extending outwardly from the central axis. Each individual segment is provided with a different power source so that each segment can provide a force to the blank flange independent of the force being applied by any other segment.

8 Claims, 1 Drawing Sheet

BLANKHOLDER FOR A DRAW PRESS

BACKGROUND OF THE INVENTION

This invention relates to apparatus for forming metal by drawing. More particularly, the invention is for a blankholder portion of a draw press which enables pressure to be differentially applied over the flange portion of a workpiece to minimize or eliminate earing of the drawing object.

A typical way to make a drawn cup is to force a flat metal blank through a die with a punch. As the shape of the blank is changed from a planar form to a cylindrical shape having a reduced diameter, the metal is stressed in tension in a radial direction and stressed in compression circumferentially. Depending upon a number of factors, such as the severity of the draw, the thickness of the blank, and forming characteristics of the metal, the blank may wrinkle in the flange adjacent to the die opening to an extent that an uneven or objectionable appearance is created in the cylinder sidewall after drawing. Another problem which may arise in drawing is earing which is the forming of tabs or ears which project upwardly from the edge of the open mouth of the drawn cylinder. Earing, at least in part, is a function of the anistropic character or nature of the metal. Anistropy is the exhibition of properties in a material of different values when measured along axes in different directions, or it is the exhibition of different reactions along different axes in response to application of external stimuli. Thus, when a circular metal blank is drawn, the response of the blank in the direction of rolling may be different than at an angle to the direction of rolling. Whether there is a difference, or the extent of the difference, depends upon the anisotropic properties of the metal which, in turn, depends upon the composition and temper of the metal and fabricating practice in making the sheet. If the metal is anisotropic, the blank flange will develop thickened portions along predictable radial lines as the blank is compressively stressed in being drawn into the die. In drawing, the clearance between the punch and the die is such that there is substantially no reduction in thickness in any portion of the sidewall of the cup as it is drawn, and the thickened portions will be substantially parallel in the drawn cup sidewall. The number of thickened portions and the degree of thickening is a function of the anisotropic properties of the metal and the severity of the draw. In addition to the metal being nonuniform in thickness circumferentially, it varies in thickness from top to bottom of the can; i.e., the sidewall increases in thickness from the bottom to the top. Earing is directly related to the anisotropic characteristics of the metal and its tendency to generate thickened portions during drawing. The ears or tabs are extensions beyond the rim of the cup of the thinner portions between the thickened portions. The ears generally occur in groups of 4 or 8 with the peaks of the projections located at 45 degrees and/or at 0 and 90 degrees to the rolling direction. The number of ears is a function of the anisotropic characteristics of the metal. Earing is undesirable for a number of reasons, such as excess scrap generation in trimming, and breaking off the ears, and thus generating a risk of damage to the workpiece or tooling.

The use of pressure pads or blankholders around the die opening can minimize or eliminate the formation of wrinkles. Thus, if the portion of the tooling around the periphery of the die opening is adapted to squeeze or clamp the blank flange with sufficient pressure to hold it flat without reducing it in thickness while permitting it to slide radially inwardly into the die opening, a drawn cylinder can be formed without encountering the problems created by wrinkling. The effectiveness of such clamping has its limitations, however. It may not be effective in preventing thickening, or the pressure required to prevent wrinkling or thickening may be so great as to prevent the blank from being drawn into the die and, as a result, the blank will fracture.

A number of solutions to the problem of overcoming wrinkling and earing in deep drawn articles have been proposed. Beck U.S. Pat. No. 3,349,153 discusses deep drawing thin films or foil. The blank is held between clamping jaws having a plurality of concentric grooves in one or both of the jaws. The grooves are connected to a compressed air source, and as pressure is applied to the punch to force the blank through the die, the air pressure to the grooves is increased until the jaws are forced apart sufficient to permit the film or foil to slide. Thus, the clamping pressure is balanced against the drawing force, and as the blank is drawn inwardly, less and less clamping pressure is required. By providing a mechanism for varying the clamping force during the draw cycle, fracture of the cylindrical article is prevented. Meyers U.S. Pat. No. 3,420,089 is concerned with making cylindrical shapes having domed-shaped ends. According to Meyers, at least a part of the problem with prior drawing apparatus is that the blankholder or draw ring is adapted in a manner that pressure is applied to the blank unevenly and, as a consequence, the metal forms unevenly. To overcome uneven application of pressure, Meyers provides a blankholder which has three concentric rings, each of which is connected to separate fluid pressure sources. Thus, a different pressure can be applied uniformly to each portion of the blank in contact with the rings. The innermost ring supplies the highest unit pressure since the greatest pressure is needed there to prevent wrinkling. Saunders U.S. Pat. No. 3,494,169 also attributes wrinkling and earing problems to a nonuniform application of pressure. Saunders states that with the use of conventional tooling, the unit pressure on the blank increases as the blank is drawn because the force imposed with the blankholder is distributed over an ever-decreasing area of the blank. This may result in creating a tensile stress sufficient to thin the metal as it is drawn. Saunders provides a blankholder having independently movable concentric rings. The rings sequentially apply pressure to the blank as it is drawn inwardly, and thus a uniform pressure is maintained on the blank throughout the drawing cycle.

The foregoing are but a few of the many patents directed to solving the problem of preventing wrinkling and earing in making deep drawn articles. Blankholders having concentric rings capable of applying varying levels of force to the flange are satisfactory for controlling wrinkles and can also be effective in preventing earing. However, the rings may be subject to deflection or cocking out of a plane parallel to the flange resulting in a distribution of force on the flange which does not insure thinning of all of the thickened portions and thus eliminate earing.

SUMMARY OF THE INVENTION

A blankholder of this invention is a hollow cylindrical body divided into a plurality of segments defined by radii and at least one circle concentric with the blankholder axis. Each segment is adapted for movement independent from each of the other segments so that a force from the blankholder can be incrementally applied along selected radial lines on a metal blank to be drawn. By limiting the application of force to only predetermined portions of the blank and in an amount necessary to prevent thickening of such portions, the blank can be maintained with a substantially uniform thickness as it flows radially inward into the draw die.

It is an objective of this invention to prevent thickening of radial portions of a flange of a workpiece as it is drawn into a cylindrical body to eliminate earing on the sidewall of the body.

This and other objectives and advantages will be more apparent with reference to the following description of a preferred embodiment and accompaning drawing.

DESCRIPTION OF THE PREFERRED EMBODIMENT

Figure 1:
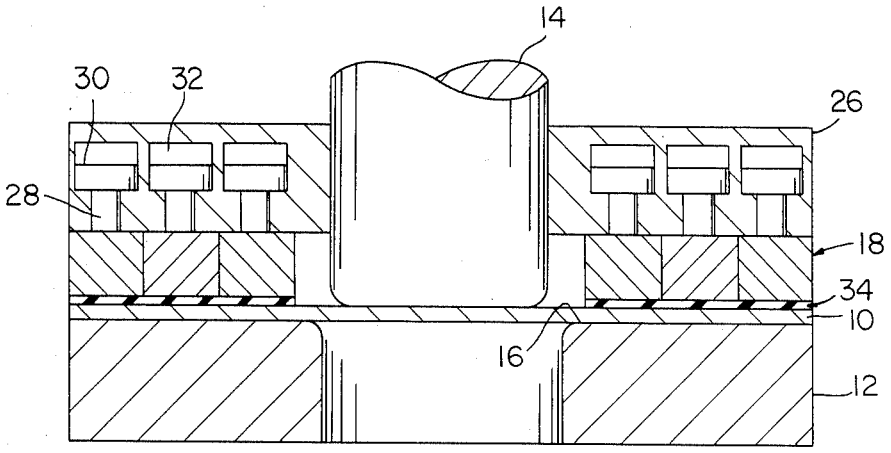
FIG. 1 is a cross-sectional view of a blankholder of this invention, and a fragmentary portion of a punch and draw die with a metal blank held between the blankholder and draw die preparatory to the blank being forced through the die with the punch.
Figure 2:
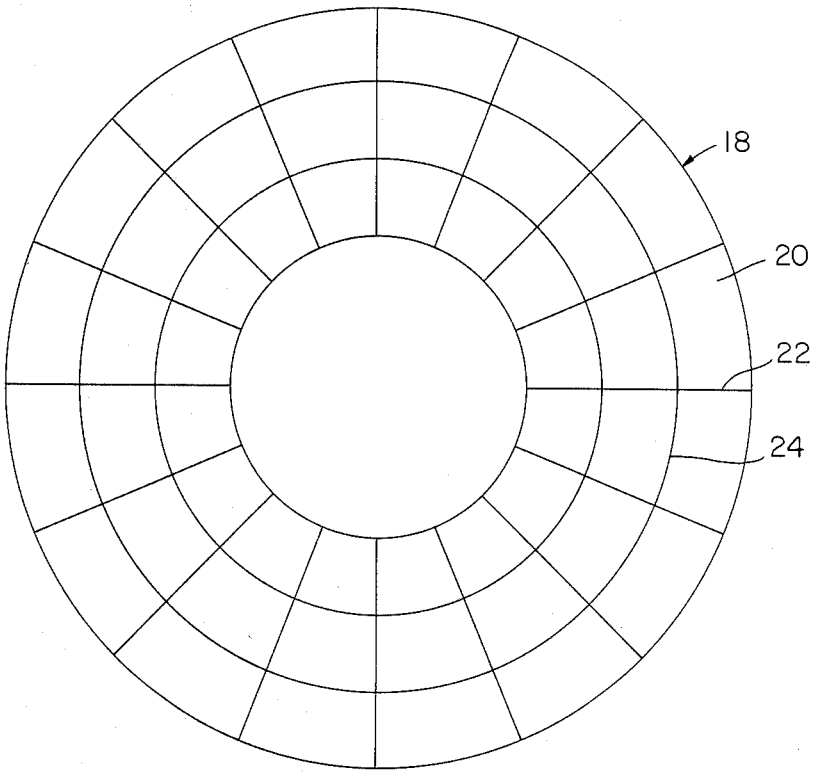
FIG. 2 is a view of the bottom surface of the blankholder shown in FIG. 1.

In FIG. 1 a circular metal blank 10 is positioned over a die 12 preparatory to being drawn into a cylindrical shape by applying a downward force with the punch 14. The blank 10 is held in position against the die face 16 by applying pressure through the blankholder 18. The blankholder 18 is a circular block and is divided into segments 20 defined by radii 22 and continuous divisions between segments which, in the case of a cylindrical blankholder as in this preferred embodiment, are concentric circles 24. Each segment 20 is capable of being moved independently of each of the other segments by a power source. In this preferred embodiment, the power source is a hydraulic system. A circular base and piston housing 26 holds and positions a drive rod 28 over each individual blankholder segment 20. Each rod 28 is attached to a piston 30 within a cylinder 32 which is adapted to apply a hydraulic fluid to the piston and thereby vary the force being applied to each segment.

The capability of selectively varying the pressure applied to each segment 20 provides means for controlling the pressure or force delivered by the blankholder 18 along radial lines. The ability to vary the pressure along radial lines is particularly important to control earing.

As previously noted, the flange of a blank being drawn through a die may thicken along lines radiating from the center of the blank and ears may occur around the rim of a drawn article as extensions of the thinner portions between the thicker portions. Preventing the thickening of such portions in the flange maintains the blank with a substantially uniform wall thickness as its flows inwardly into the die and enables forming a drawn object without earing. The extent of thickening, earing, and the lines along which such formations could be expected with unrestrained drawing of a blank of a particular alloy and temper can be determined analytically or experimentally. The amount of force or pressure to be applied by each segment 20 of the blankholder 18 to the blank flange to prevent the metal from thickening or flowing radially outwardly can also be determined analytically or experimentally. Thus, in one method of using a blankholder of this invention, the drawing cycle can be computer controlled with a program derived from analytically or experimentally obtained data. The advantage of being able to vary the amount of force independently delivered by each segment 20 is to use no more force than is necessary to eliminate the thickened portions and thereby reduce the risk of tearing the blank during drawing. It is also advantageous to apply the required force in small independent segments 20 to prevent an undesired deflection or cocking of the blankholder 18 due to circumferential variations in thickness of the thickened portions. It may be seen that at the beginning of drawing the blank 10 through the die 12, only a slight amount of force from the blankholder 18 is required to keep the blank 10 flat and prevent thickening. As drawing progresses, however, there is a progressively greater potential for wrinkling and thickening in the blank flange as ever-increasing amounts of inwardly flowing metal are subjected to a circumferential compressive stress. By providing individually controlled segments 20 in the blankholder 18, the force applied by one segment does not affect any other portion of the blankholder; i.e., a force imbalance will not cause an adverse deflection or clocking of the blankholder. It has already been noted that in one method of using a blankholder 18 of this invention, the force to be applied to each segment throughout the drawing cycle can be predetermined. In another method of using the invention, the force applied to each segment can be in response to variations in the load imposed upon the segment from the flange throughout the drawing cycle. For example, the hydraulic system supplying the power to each piston 30 can be adapted to supply the power or force necessary to prevent or limit the upward vertical movement of each segment. In this way, the wall thickness of the drawn article can be held to a substantially uniform value.

Although it is not essential to the invention, a disc 34 of a material such as a hard rubber, for example, can be interposed between the blankholder 18 and the upper surface 16 of the die 12. Such a disc may be beneficial to prevent abrading or scuffing the blank due to the pressure of the clamping action of the blankholder segments 20.

While the invention has been described in terms of preferred embodiments, the claims appended hereto are intended to encompass all embodiments which fall within the spirit of the invention.

What is claimed is:

1. Apparatus for drawing a blank into an open mouth object, comprising:

a die having an opening and a surface to support a blank thereon;

a punch in coaxial alignment with the die opening and adapted for movement through the die opening to force said blank through the opening and thereby form a hollow open mouth drawn object having an end wall and a sidewall;

a blankholder assembly comprising a base adapted for axial movement in coaxial alignment with the punch and a block connected to the base and having an outer periphery and a punch opening therein to accommodate movement of the punch therethrough, said block comprising a plurality of segments around said punch opening and between said punch opening and said segments being bounded both by a plurality of radial divisions in said block and by one or more divisions spaced between said punch opening and said outer periphery, each of said segments being movable independently of each other and of said base; and power means for application of a separate force parallel to the blankholder axis to each of the independent segments.

2. Apparatus as claimed in claim 1 wherein the block of the blankholder is a hollow cylinder.

3. Apparatus as claimed in claim 1 wherein the blankholder block includes at least four radial divisions.

4. Apparatus as claimed in claim 1 which further includes a disc suitable for positioning between the blankholder block and a blank to be drawn, the disc made of a material which enables sliding of the blank against it without scuffing or otherwise marking the blank.

5. A blankholder for applying pressure to a flange on a blank extending outwardly from an opening in a die in a draw press, comprising:

a base, a cylindrical block connected the base and having a blankholding surface and a punch opening in coaxial alignment with the die and adapted for axial movement so as to contact the blank flange with the blankholding surface, and with the block divided into separate segments defined by inner and outer cylindrical surfaces of the block, at least one circular division coaxial with the block axis and spaced between the inner and outer cylindrical surface, and radial divisions extending from the opening to the periphery of the block, each of said segments being movable independently of each other and of said base. and power means to apply a force parallel to the block axis to each of the separate segments so that each segment may be forcefully applied against the blank flange independent of all other segments.

6. Apparatus for drawing a blank into an open mouth object, comprising:

a die having an opening and surface to support a blank thereon;

a punch in coaxial alignment with the die opening and adapted for movement through the die opening to force the blank through the opening and thereby form a hollow open mouth drawn object having an end wall and a sidewall;

a blankholder adapted for axial movement in coaxial alignment with the punch and having a base and a block connected to said base, said block having a punch opening to accommodate movement of the punch therethrough said block being divided into two or more rows of independent segments around the punch opening with segments in each row in an abutting relationship along lines extending outwardly from the punch opening, each of said segments being movable independently of each other and of said base; and power means for application of a separate force parallel to the blankholder axis to each of the independent segments.

7. Apparatus as claimed in claim 6 wherein the block of the blankholder is a hollow cylinder.

8. Apparatus as claimed in claim 6 wherein the blankholder block includes at least four independent segments in each row.

* * * * *